US006224504B1

(12) United States Patent
Tien

(10) Patent No.: US 6,224,504 B1
(45) Date of Patent: May 1, 2001

(54) BASKETBALL PRACTICE ASSEMBLY

(76) Inventor: Feng Yi Tien, P.O. Box 82-144, Taipei (TW)

( * ) Notice: Subject to any disclaimer, the term of this patent is extended or adjusted under 35 U.S.C. 154(b) by 0 days.

(21) Appl. No.: 09/450,449

(22) Filed: Nov. 30, 1999

(51) Int. Cl.[7] ..... A63B 69/00

(52) U.S. Cl. ..... 473/433; 473/422; 473/431; 473/447; 273/317.3

(58) Field of Search ..... 273/317.3; 473/476, 473/479, 480–489, FOR 101, FOR 135, 431–433, 447, 415, 472; 220/9.1–9.3; 206/315.1, 315.9, 579, 457

(56) References Cited

U.S. PATENT DOCUMENTS 4,838,549 * 6/1989 Woodall ..... 473/433
4,974,843 * 12/1990 Henningsson ..... 473/431
5,133,546 * 7/1992 Matherne et al. ..... 273/375
5,171,009 * 12/1992 Filewich et al. ..... 473/433
5,273,275 * 12/1993 Wilkerson ..... 473/433
5,358,237 * 10/1994 Yu ..... 473/480
5,692,976 * 12/1997 Yu ..... 473/433
5,819,998 * 10/1998 Chehebar ..... 224/153

* cited by examiner

*Primary Examiner*—Stephen F. Gerrity
*Assistant Examiner*—Mitra Aryanpour

(57) ABSTRACT

A basketball practice assembly a case including a box-like receptacle which is open at a front side thereof, and a pair of doors hingedly connected with two lateral sides of the box-like receptacle, a pair of fixing members fastened in the box-like receptacle by screws and having a vertical dovetail groove, a pair of telescopic arms each having two inner ends and two outer ends, one of the inner ends being fixedly engaged with the vertical dovetail groove, another one of the inner ends being slidably fitted in the vertical dovetail groove, a net arranged on the telescopic arms to form a rectangular member with an open top, a backboard installed in the receptacle, and a basket pivotally mounted on the backboard.

2 Claims, 4 Drawing Sheets

BASKETBALL PRACTICE ASSEMBLY

BACKGROUND OF THE INVENTION

1. Field of the Invention

This invention is related to a basketball practice assembly and in particular to one which can be folded into a case on the wall when not in use.

2. Description of the Prior Art

The conventional basketball practice device generally includes a primary support for holding a backboard and a basket above the ground, a plurality of secondary supports configured to form a frame parallel to the primary support and standing on the ground, a plurality of telescopic links slidably mounted between the primary and secondary supports, and a net connected between the supports and having an open top, whereby the supports can be folded together when not in use. Nevertheless, the primary and secondary supports are arranged on the ground so that even if they are collapsed, the basketball practice device must still occupy a considerably large space on the ground thereby making it unfit for practical use.

Therefore, it is an object of the present invention to provide an improved basketball practice assembly which can obviate and mitigate the above-mentioned drawbacks.

SUMMARY OF THE INVENTION

This invention is related to an improved basketball practice assembly.

According to a preferred embodiment of the present invention, a basketball practice assembly a case including a box-like receptacle which is open at a front side thereof, and a pair of doors hingedly connected with two lateral sides of the box-like receptacle, a pair of fixing members fastened in the box-like receptacle by screws and having a vertical dovetail groove, a pair of telescopic arms each having two inner ends and two outer ends, one of the inner ends being fixedly engaged with the vertical dovetail groove, another one of the inner ends being sidably fitted in the vertical dovetail groove, a net arranged on the telescopic aims to form a rectangular member with an open top, a backboard installed in the receptacle, and a basket pivotally mounted on the backboard.

It is the primary object of the present invention to provide an improved basketball practice assembly which can be folded into a case when not in use.

It is another object of the present invention to provide an improved basketball practice assembly which will not occupy any space on the ground when not in use.

It is still another object of the present invention to provide an improved basketball practice assembly which can be easily extended for use.

It is still another object of the present invention to provide an improved basketball practice assembly which is simple in construction.

It is a further object of the present invention to provide an improved basketball practice assembly which is low in cost and easy to manufacture.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
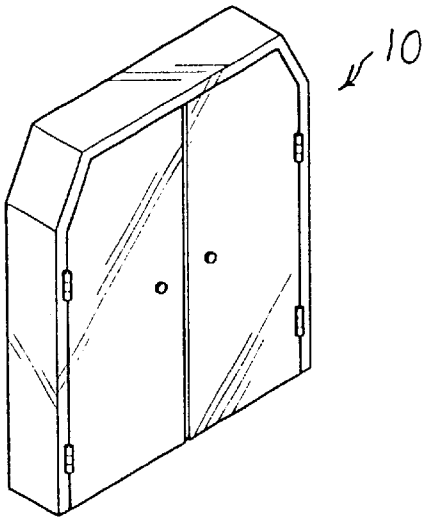
FIG. 1 is a perspective view of the present invention shown in a collapsed position.
Figure 2:
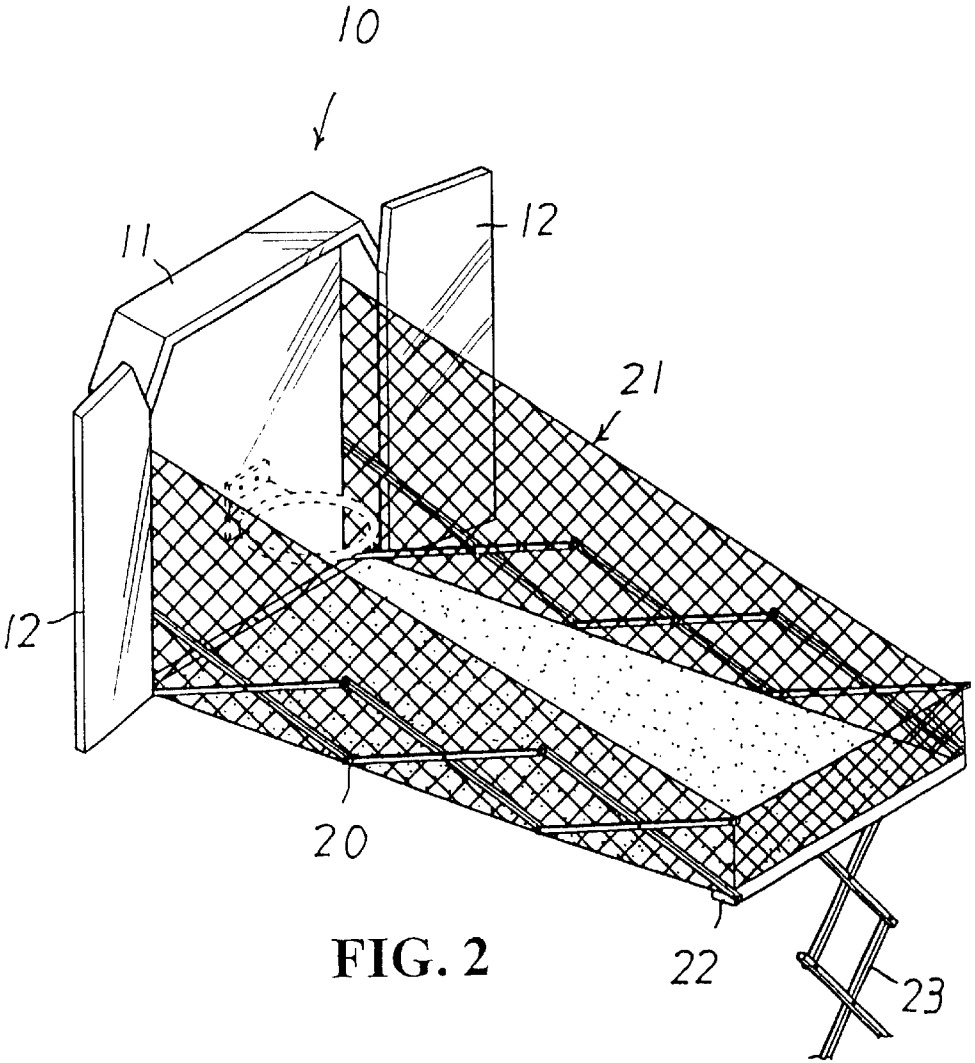
FIG. 2 is a perspective view of the present invention shown in an open position.
Figure 3:
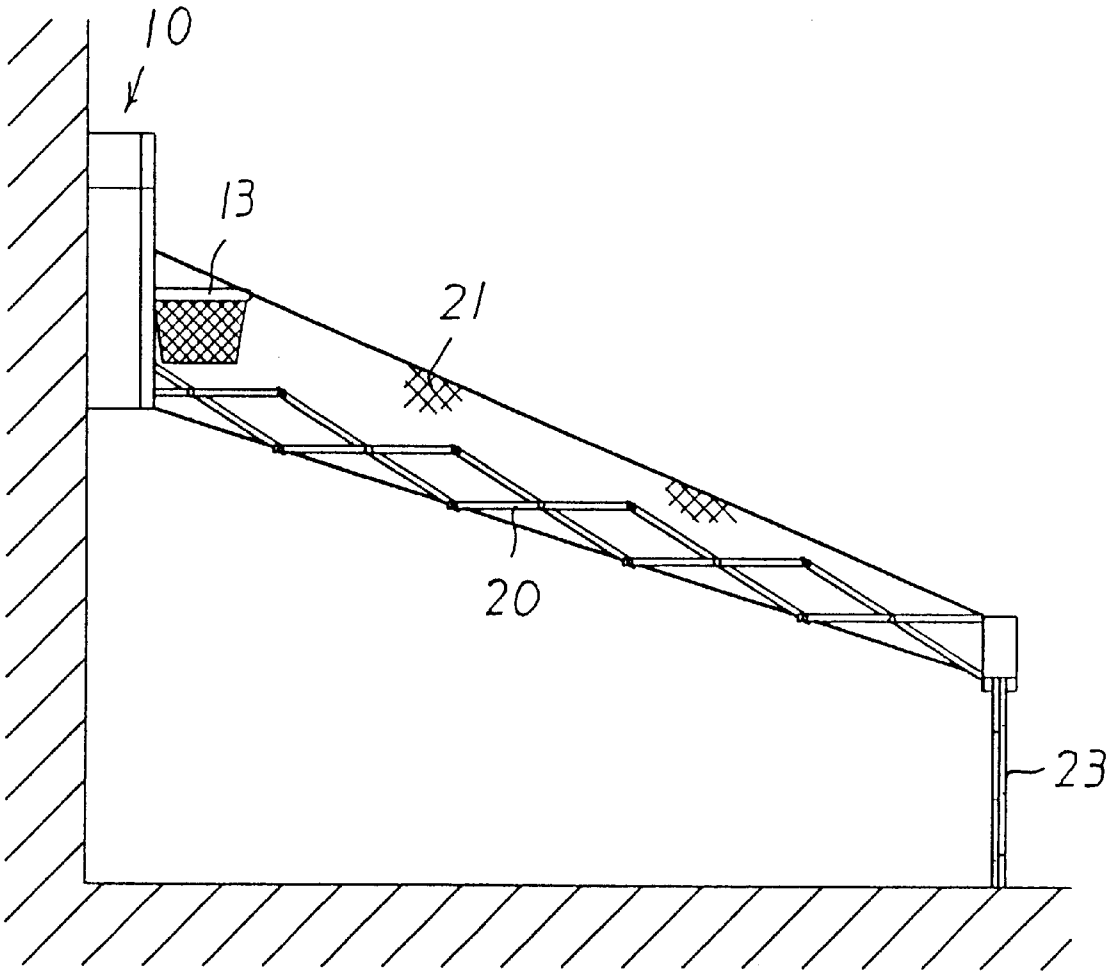
FIG. 3 is a side view of the present invention shown in an open position.
Figure 5:
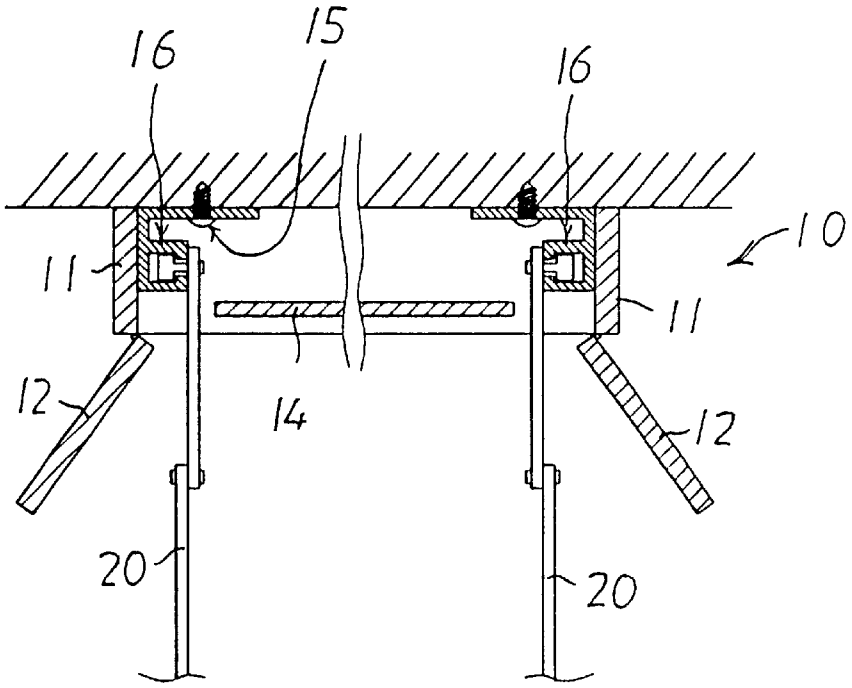
FIG. 5 is a sectional view of the present invention shown in an open position.
Figure 4:
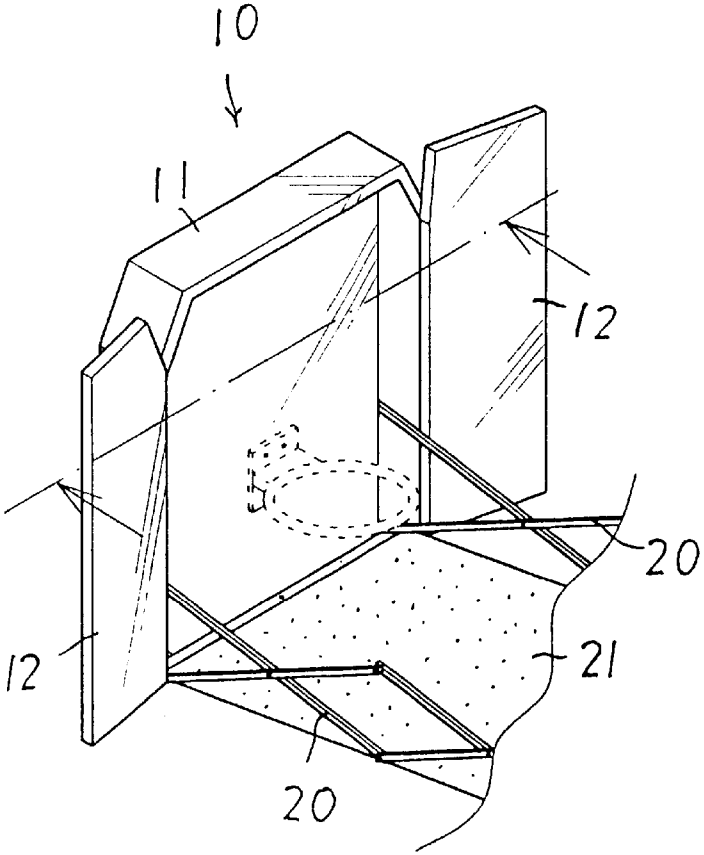
FIG. 4 illustrates the present invention in an open position.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 6:
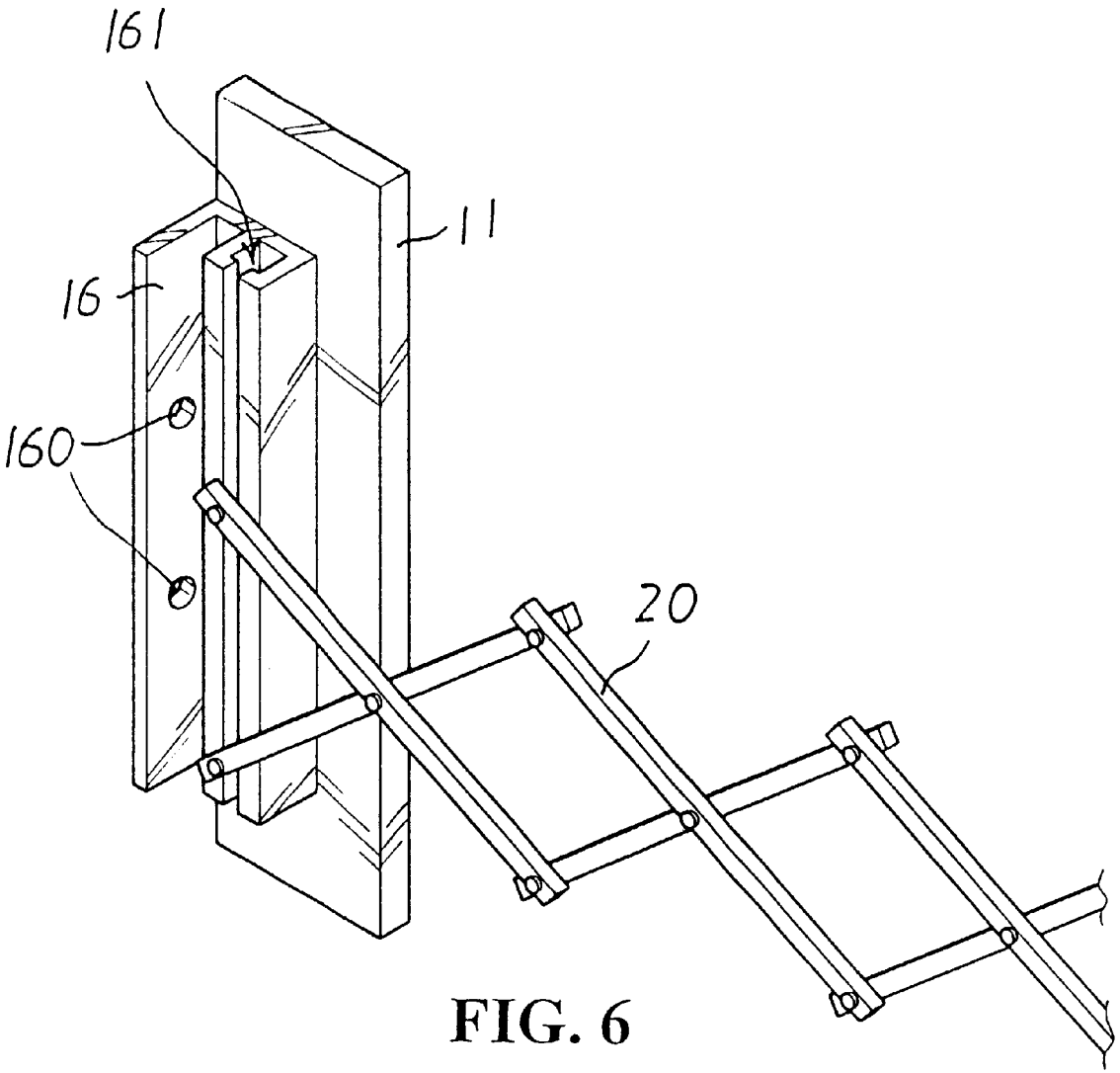
FIG. 6 is a perspective view of the telescopic arm.

With reference to the drawings and in particular to FIGS. 1, 2, 3, 4 and 5 thereof, the basketball practice assembly according to the present invention generally comprises a case 10 having a box-like receptacle 11 which is open at the front side thereof, and a pair of doors 12 hingedly connected with two lateral sides of the receptacle 1. Two fixing members 16 are fastened in the receptacle 11 by extending screws 15 through holes 160 of the fixing members 16 into the receptacle 11 (see FIGS. 5 and 6). The fixing member 16 is formed with a vertical dovetail groove 161 engaged with two inner ends of a telescopic aim 20. One of the inner ends of the telescopic arm 20 is fixedly engaged with the vertical dovetail groove 161, while the other inner end of the telescopic arm 20 is slidably fitted in the vertical dovetail groove 161, so that the telescopic arm 20 can be folded into the receptacle 11 or pulled out of the receptacle 11 as required. A net 21 is mounted on the two telescopic arms 20 to form a rectangular member with an open top. A backboard 14 (see FIG. 5) is arranged in the receptacle 11 with a distance from two sides of the receptacle 11. A basket 13 is pivotally mounted on the backboard 14 so that the basket 13 can be folded on the backboard 14 when not in use. A guiding rod 22 is installed between the outer ends of the two telescopic arms 20. The upper ends of a telescopic leg 23 are connected with the lower side of the guiding rod 22 so that the telescopic leg 23 can be pulled downwardly to stand on the ground (see FIG. 3).

When not in use, the telescopic arms 20, the telescopic leg 23 and the net 21 are first folded into the receptacle 11 and then the doors 12 are closed, so that the basketball practice assembly according to the present invention will not occupy any space on the ground when not in use.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A basketball practice assembly comprising:

a case including a box-like receptacle which is open at a front side thereof, and a pair of doors hingedly connected with two lateral sides of said box-like receptacle;

a pair of fixing members fastened in said box-like receptacle by screws and having a vertical dovetail groove;

a pair of telescopic ands each having two inner ends and two outer ends, one of said inner ends being fixedly engaged with said vertical dovetail groove, another one of said inner ends being slidably fitted in said vertical dovetail groove;

a net arranged on said telescopic arms to form a rectangular member with an open top;

a backboard installed in said receptacle; and a basket pivotally mounted on said backboard.

2. The basketball practice assembly as claimed in claim 1, further comprising a guiding rod mounted between said outer ends of said telescopic arms and a telescopic leg connected with a lower side of said guiding rod.

* * * * *